US008361285B2

(12) United States Patent
Krone et al.

(10) Patent No.: US 8,361,285 B2
(45) Date of Patent: Jan. 29, 2013

(54) ELECTROCHEMICAL ANTIFOULING SYSTEM FOR SEAWATER-WETTED STRUCTURES

(75) Inventors: Roland Krone, Bremen (DE); Markus Paster, Velbert (DE)

(73) Assignee: Stiftung Alfred-Wegener-Institut fuer Polar-und Meeresforschung, Bremerhaven (DE)

( * ) Notice: Subject to any disclaimer, the term of this patent is extended or adjusted under 35 U.S.C. 154(b) by 83 days.

(21) Appl. No.: 12/913,388

(22) Filed: Oct. 27, 2010

(65) Prior Publication Data

US 2011/0100804 A1 May 5, 2011

(30) Foreign Application Priority Data

Oct. 30, 2009 (DE) ..... 10 2009 051 768

(51) Int. Cl.
*C23F 13/04* (2006.01)

(52) U.S. Cl. ..... 204/196.37; 204/196.02; 204/196.03; 204/196.05; 204/196.1; 204/196.19; 204/196.2; 204/196.33; 204/196.36

(58) Field of Classification Search ..... 204/196.02, 204/196.03, 196.05, 196.1, 196.19, 196.2, 204/196.33, 196.36, 196.37
See application file for complete search history.

(56) References Cited

U.S. PATENT DOCUMENTS

| | | | | |
|---|---|---|---|---|
| 4,440,611 | A | | 4/1984 | Dhar et al. |
| 5,344,531 | A | * | 9/1994 | Saito et al. ..... 205/701 |
| 5,543,034 | A | | 8/1996 | Hilbertz et al. |
| 6,389,972 | B2 | | 5/2002 | Duvacquier et al. |
| 2009/0317295 | A1 | | 12/2009 | Yonesu et al. |

FOREIGN PATENT DOCUMENTS

| | | | |
|---|---|---|---|
| DE | 4109197 | C2 | 2/1995 |
| DE | 4109198 | C2 | 6/1995 |
| DE | 69802979 | T2 | 6/2002 |
| DE | 102004039593 | B4 | 7/2007 |
| JP | 2004-270164 | A | 9/2004 |
| JP | 2004-278161 | A | 10/2004 |
| JP | 2007-268252 | A | 10/2007 |

OTHER PUBLICATIONS

2001 NOMATEC Project, subject "Electrochemical Accretion Technology" (EAT), Introduction and progress reports, 1st and 2nd project years, version of Dec. 29, 2004, http://www.unidue.de/nomatec/index_de.html, version of Sep. 29, 2009, obtained from http://www.uni-due.de/nomatec/themen_en.html on Feb. 10, 2011.

* cited by examiner

*Primary Examiner* — Bruce Bell
(74) *Attorney, Agent, or Firm* — Leydig, Voit & Mayer, Ltd.

(57) ABSTRACT

An electrochemical antifouling system for preventing fouling organisms from adhering to seawater-wetted structures includes a direct current circuit for creating an electrolytic environment in seawater, the direct current circuit having an adjustable direct current source, a lattice electrode having a single metallic component so as to provide a dimensionally stable lattice structure, the lattice electrode electrically insulated from a surface of a seawater-wetted structure, at least one corrosion-resistant counter electrode having polarity opposite to the lattice electrode and disposed at a distance therefrom, and a switching device configured to alternatively switch the lattice electrode to (a) a continuous operating mode, and (b) a temporary depletion mode, wherein the lattice electrode is disposed in a distance range from the surface of the seawater-wetted structure so that the surface lies within an area of influence of an increase in pH value of the seawater caused by electrolysis.

17 Claims, 3 Drawing Sheets

ELECTROCHEMICAL ANTIFOULING SYSTEM FOR SEAWATER-WETTED STRUCTURES

CROSS-REFERENCE TO RELATED APPLICATIONS

This is application claims benefit of priority under 35 U.S.C. §119 of German Application No. 10 2009 051 768, filed Oct. 30, 2009, which is hereby incorporated by reference herein.

FIELD

The invention relates generally to electrochemical antifouling systems for preventing fouling organisms from adhering to seawater-wetted structures, and in particular to an anti-fouling system including a direct current circuit for creating an electrolytic environment in the seawater, a lattice electrode, at least one oppositely polarised counter electrode arranged at a distance therefrom, and an adjustable direct current source.

BACKGROUND

In general, the term "fouling" or "biofouling" (biological overgrowth and aufwuchs) is used to refer to the undesirable accumulation or solid materials (marine organisms: bacteria, algae, shellfish, barnacles etc.) on rigid boundary surfaces. Antifouling measures help to prevent fouling on structures that are surrounded by marine or salt-containing water, or liquid media containing salt ("seawater"), or are at least wetted with such water intermittently or constantly. Offshore structures are usually built from steel or concrete, and are nearly always covered completely in a layer of fouling, particularly in the intertidal area. As a result, the area that is exposed to wave energy is enlarged, the surface of such structures is permanently covered so that it may be attacked or corroded, and the biological mass is itself increased locally by the aufwuchs. Inspection activities are hindered. Moreover, aufwuchs that falls off can cause oxygen depletion on the seabed, particularly in areas with little or no current movement, and negatively impact marine animal communities. Antifouling measures also help to protect wooden bodies in the water, such as mooring posts in marina parts, from clinging and boring organisms. Wooden elements can be colonised by various organisms, which can completely cover the elements and thus impair their function. In general, fouling with clinging or adhering organisms can thus destroy the surface of a structure, and this has led to more intensive measures for combating fouling, known as antifouling. Besides mechanical cleaning methods and special antifouling paints or coatings, electrochemical antifouling systems have also been developed, and a major advantage of these is that they are non-toxic.

Electrochemical antifouling systems are based on electrolysis in seawater. A direct current flowing between the anode and the cathode causes the formation of products of dissociation (cathode H+, anode OH−), which in turn raise the local pH values at the boundary surface between the electrode and the seawater (cathode basic, anode acidic). A suitable current regime for causing electrolysis at the cathode to prevent microbiological or calcareous fouling on conductive or semiconductive surfaces that are exposed to seawater is described in detail in U.S. Pat. No. 4,440,611.

DE 41 09 198 C2 describes applying a coating consisting of a binder and macromolecules with free anionic or cationic groups in the molecule to the surface that is to be protected. By controlling the DC voltage, the products of dissociation can be caused to accumulate out of the seawater and set up a specific pH value on this surface. By applying a voltage of 0.3 $V/cm^2$, the pH value can be raised to basic values of pH 9-10 due to protonation at the cathode. For purposes of antifouling protection, it is known from DE 41 09 197 C2 to switch the polarity of the DC voltage continuously according to a random principle, causing the pH values to change between acidic and basic. This also repels organisms that are able to tolerate constantly strong basic or acidic pH values.

A similar antifouling system is described in DE 698 02 979 T2, in which a layer having a streaked structure or thin metal strips are applied underneath a continuous conductive layer having a different resistance behaviour, so that the current density created can be adjusted specifically depending on the nature of the overgrowth. An antifouling system including electrode plates positioned in front of the surface to be protected is described in JP 2004-278161 A. It is also described in JP 2004-270164 A to secure these electrode plates by supporting them in rails.

Another consequence of electrolysis in seawater is that minerals are also precipitated on the cathode (mineral accretion). This is described in U.S. Pat. No. 5,543,034. This precipitate is particularly hard aragonite (a polymorph of calcite, calcium carbonate CaCO3, mohs hardness from 3.5 to 4.5 and noticeable cleavage in one direction) and soft brucite (magnesium hydroxide Mg(OH)2, mohs hardness 2 to 2.5, easily cleaved in one direction). The deposit of hard aragonite in particular can be used to build artificial reefs (biorock technology), on which the growth of aquatic organisms is deliberately encouraged. The rise in pH value of 0.1 compared with equilibrium (average pH value 8.2) that is observed when the aragonite is deposited also promotes increased growth of the organisms that are to be encouraged. The cathode is also protected from corrosion by lime deposits.

Based on the biorock technology, in order to create an artificial reef, it is described in the EAT reports (2001 NOMATEC Project, subject "Electrochemical Accretion Technology" (EAT), Introduction and progress reports, 1st and 2nd project years, version of 29.12.2004, available on the internet at URL http://www.uni-due.de/nomatec/index_de.html, version of 29.09.2009) to use a framework of steel, preferably a thin wire mesh, as the cathodic matrix for electrolytic lime precipitation. A titanium lattice is used as the anode. It will be observed that the accretion of relatively soft brucite, which hinders reef formation, is an indication of high current densities in the cathode. The deposit of brucite can be counteracted by using larger cathodic surfaces.

In addition, DE 10 2004 039 593 B4 describes a method for extracting brucite from seawater by electrolysis, in which the accretion of brucite is supported deliberately by adding a magnesium salt solution. In order to promote the accretion of brucite, the current density at the cathode must be adjusted such that a pH value of at least 9.7 (with normal seawater) is achieved. In this context, it was observed that the accretion product brucite in its crystalline form is obtained with a relatively low current density at the cathode, and if a higher current density is used, brucite is precipitated in its soft, soap-like form.

JP 07-268252 describes a species-related antifouling system with a limp net through which a current is passed, serving as a water inlet channel. The net is stretched across the channel and along the channel walls in the manner of a trap. This forms the lattice electrode, and is connected as the anode. The cathode has the form of a rod and is arranged at a distance from the anode in the seawater. The cathode is not susceptible to decomposition and is therefore made from a material that is not corrosion-resistant, for example iron. However, in order to prevent the anode from being stripped away during electrolysis, the net cable is of special construction. It consists of three strands, each of which is constructed from non-conductive monofilaments surrounding a conductive metal foil of titanium or a titanium-aluminium plated material as its core. All three strands are embedded in a plastic sheath that is rendered electrically conductive by the addition of platinum powder or titanium powder. To protect the channel wall from fouling with an anodic protection, the channel wall must be electrically conductive. The current is supplied to the net, in particular to the metal foil in the core of the strands, via the electrically conductive channel wall. The net can only be removed from water inlet channel by dismantling it manually, which means that personnel must be available at the location.

SUMMARY

Embodiments of the invention provide an electrochemical antifouling system for preventing fouling organisms from adhering to seawater-wetted structures. The system includes a direct current circuit for creating an electrolytic environment in seawater, the direct current circuit having an adjustable direct current source. A lattice electrode is provided having a single metallic component so as to provide a dimensionally stable lattice structure, the lattice electrode electrically insulated from a surface of a seawater-wetted structure. At least one corrosion-resistant counter electrode is provided having a polarity opposite to the lattice electrode and disposed at a distance from the lattice electrode. A switching device is provided configured to alternatively switch the lattice electrode to (a) continuous operating mode with the lattice electrode functioning as a cathode, wherein the direct current source is adjusted so as to generate a current density so as to provide an accretion of soft brucite at the lattice electrode and a pH value higher than a pH value tolerance limit of fouling organisms that are to be combated in the seawater, and (b) temporary depletion mode with the lattice electrode functioning as an anode, wherein the direct current source is adjusted so as to generate a direct current density so as to provide a reduction in oxidation at the lattice electrode and complete dissolution of the lattice electrode. The lattice electrode is disposed in a distance range from the surface of the seawater-wetted structure so that the surface lies within an area of influence of an increase in the pH value of the seawater caused by electrolysis.

BRIEF DESCRIPTION OF THE DRAWINGS

Embodiments of the electrochemical antifouling system according to the invention will be explained in greater detail in the following with reference to the diagrammatic figures for clearer understanding. In the drawings.

DETAILED DESCRIPTION

Figure 1:
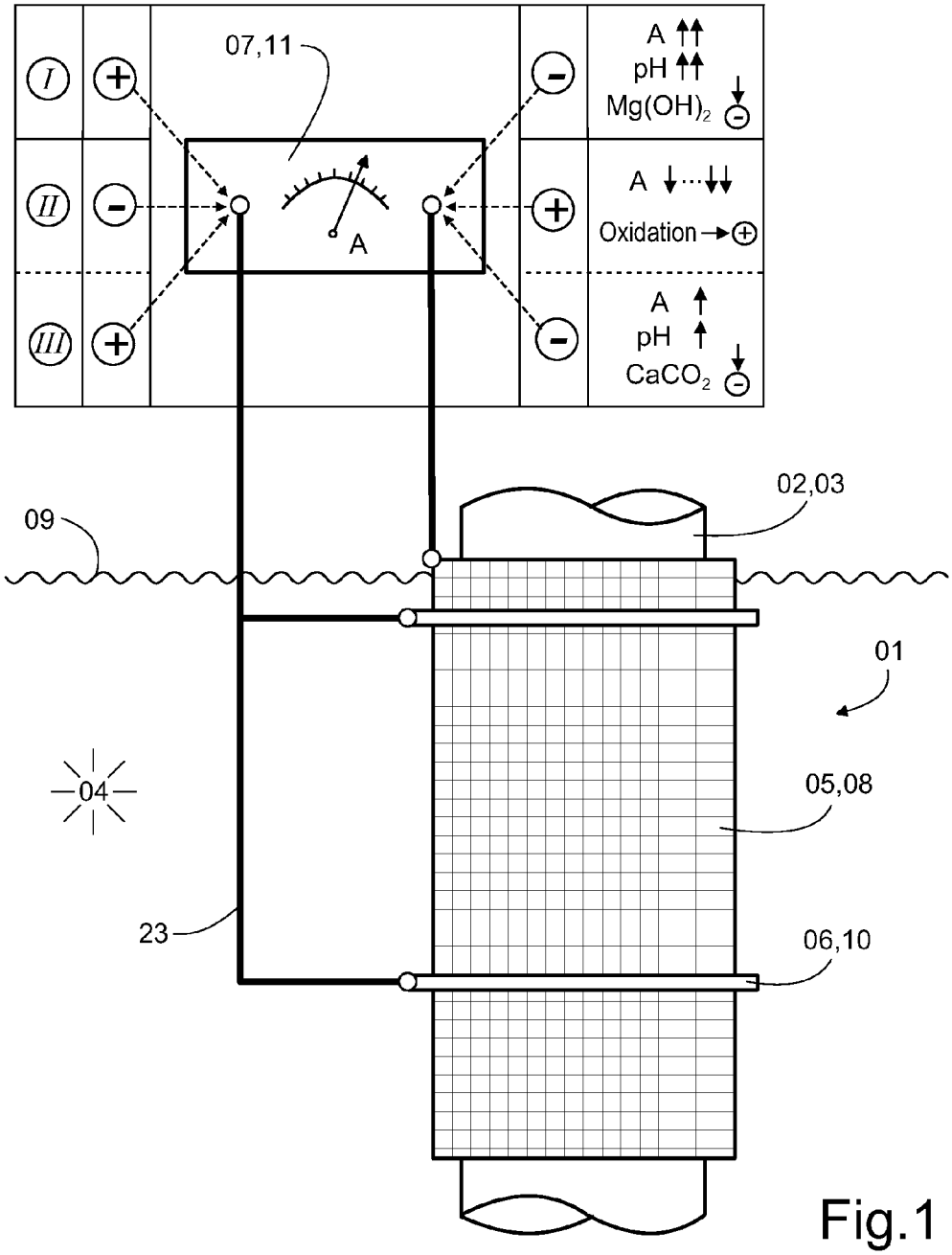
FIG. 1 is a general view of the electrochemical antifouling system in an arrangement on a foundation pile.

Embodiments of the invention are used to provide an improved antifouling system of the species-related type in such manner that the lattice electrode may be constructed as simply as possible, and does not undergo any corrosion in normal operation. There is no essential requirement to provide an electrically conductive surface on the structure to be protected, but extremely effective fouling protection can be assured. It is possible to dismantle the lattice electrode without having to deploy personnel to the site.

In the antifouling system according to the invention, the lattice electrode is dimensionally stable and is made from a single metal component, so its structure is extremely simple, resilient, and inexpensive. The lattice electrode is self-supporting and solidifies in the selected shape. It is arranged at such a distance in front of the surface of the structure to be protected that the surface is in the area of influence of a rise in the pH of the seawater brought about by electrolysis. The surface of the structure does not need to be protected anodically. The counter electrode is made from a corrosion-resistant material. The counter electrode is also electrically insulated from the surface of the structure. As a result, it is ensured that the current only flows through the lattice electrode, not through the surface of the structure. Accordingly, the surface of the structure may be designed such that certain areas are electrically conductive and others are electrically non-conductive.

These provisions also represent a device for alternative switching of the lattice electrode in the antifouling system according to the invention, thereby making the system particularly versatile and easy to handle. With this switching device, in theory it is possible to set two different modes of use for the antifouling system according to the invention. On the one hand, a continuous operating mode may be selected by switching the lattice electrode to function as the cathode. Switching the lattice electrode to function as the cathode protects it from decomposing due to electrolysis, and thus also from corrosion. No symptoms of wear occur, installation costs are only incurred once. At the same time, the DC current source is selected such that the current density created causes accretion of soft brucite on the lattice electrode and raises the pH value above the pH level tolerance limit for the fouling organisms in seawater that the device is designed to combat. Accordingly, this operating mode offers dual antifouling protection. Firstly by achieving a high pH value in the seawater, which is above the tolerance limit for the organisms that are to be repelled. Such organisms include for example the goose barnacle (*Pollicipes pollicipes*), which colonises hard substrates but seldom or no longer colonises surfaces where the pH value is about 8.9. As a field variable, the pH value has a wide range of influence, and thus also protects the surface of the structure behind the lattice electrode from being colonised. Fouling organisms are prevented from establishing colonies. Charging with direct current induces an electrolytic process that causes the pH value to rise sharply at the metal-water boundary layer. The barrier this creates is very difficult or impossible for organisms and their larvae to pass through when adapted lattices are used. In this example it is preferable to use small mesh sizes, 0.4 cm, for example, since this further intensifies the increase in pH value relative to the area.

Secondly, a soft blanket of brucite forms on the lattice electrode with spatially limited influence. Brucite has perfect cleaving properties in one direction, and is therefore easy to shear off. Fouling organisms that have an unusually high pH value tolerance or which are exceptionally able to acclimatise to a constant pH increase, are therefore simply washed off together with the soft brucite by the motion of the seawater shortly after they form a colony on the lattice electrode. Above a pH value of 9.7, brucite (mohs hardness 2 to 2.5) is deposited during electrolysis. Particularly in order to create high pH values and brucite, it is necessary to set a high current density, in a range of 30 $A/m^2$ and higher relative to the effective surface area of the lattice electrode. One notable side-effect of this is the formation and release of hydrogen, which under certain circumstances is abundant, and is generated with high current densities by the reduction of cations on the lattice structure. This hydrogen formation is also beneficial for antifouling because it is poorly tolerated by the colonising organisms close by.

The second mode of operation of the invention is a temporary depletion mode with switching of the lattice electrode as the anode. With a simple polarity inversion of the current source, the lattice electrode is converted into the anode, and is therefore depleted accordingly during electrolysis. Because buildup is based on a single metal component of the lattice structure, complete depletion may be achieved quickly and easily. In this way, the lattice electrode is able to be removed simply by reversing the polarity of the direct current source, without the need to send personnel to the site. Particularly in the case of facilities in inaccessible offshore regions, this represents a major advantage. For example, it may have to be removed if it is completely, or at least partly, destroyed—for example if the lattice electrode is damaged irreparably or excessively overgrown with aufwuchs organisms—, or if the structure to be protected itself is removed. Then, the lattice electrode may simply be disintegrated by reversing the polarity, and then—if the structure is to remain in place—replaced with a new one. Any existing devices for insulating the lattice electrode electrically from structure, for example isolators, are left on the structure and may then be used again. If the metallic component contains iron, no negative effects are anticipated when the lattice structure (of any size) is depleted or disintegrated, because an essential plant nutrient iron is limited in the marine environment. Toxic load in the event of depletion is avoided at all times. The quantity of iron released may be controlled such that it may be dosed at any time with the current density and the surface potential of the lattice electrode functioning as the anode induced thereby.

In the antifouling system according to the invention, the lattice electrode is electrically insulated from the surface of the structure that is to be protected. This may be achieved on the one hand by constructing the surface of the structure so that it is electrically non-conductive. In this context, the structures may be made from wood, for example—such as wooden mooring posts—or from concrete—such as foundation poles for wind turbines. If the surface of the structure is electrically conductive—such as barrier installations—insulators made from plastic or ceramic, for example, or an insulation mat made for example from plastic or mineral fibre may advantageously be provided to ensure that the lattice electrode is electrically insulated from an electrically conductive surface of the structure. If the surface is not conductive, as in the case of wooden or concrete structures, for example, the lattice electrode may preferably also be laid directly on the surface of the structure. In this way, the electrical charge does not pass through the entire structure with its electrically conductive surface, but only through the lattice electrode in front of it, with advantageous results in terms of low current consumption (low voltage current).

The lattice electrode used in the invention is a simple arrangement constructed from a single metallic component. In this context, it may be simple, uninsulated steel or wire mesh, in particular even simple wire netting made from a thin, uninsulated steel wire may be used. The counter electrode may be in the form a rod electrode and arranged in the seawater at a distance from the cathode. The counter electrode may advantageously also have the form of a lattice electrode. It may equally well have the form of a flat ribbon electrode, which extends in front of the flat lattice electrode. The counter electrode is advantageously also rigid and remains in a bent shape.

A particular advantage of the antifouling system according to the invention is that is able to be mounted subsequently on existing structures. As a rule, the known systems do not offer this advantage. It is also possible to expand the antifouling system according to the invention advantageously in modular fashion by connecting multiple lattice electrodes and counter electrodes together. This may be useful if the structure to be protected is modified or enlarged, or if only part of the structure is initially covered with the antifouling system. In this context, installation is generally facilitated if the lattice electrode and/or the counter electrode are of flexible construction. Because of its dimensional stability, the lattice electrode remains fixed in any position and may thus be arranged in self-supporting manner. Because of its flexibility, the lattice electrode may also be adapted optimally to match the shape of the structure that is to be protected. Even critical surfaces may be covered with the lattice electrode in this way. The same applies for the counter electrode, if this is also of flexible construction. In this case, bending is reversible, so that its shape may be changed during operation, or it may even be reused multiple times—unless it is intended to deplete the lattice electrode by polarity reversal. Moreover, the dimensional stability of the lattice electrode is not extremely pronounced, particularly when simple wire netting is used to form the lattice electrode. Then, it may be advantageous if the steel or wire mesh lattice electrode has a static pleating. Similarly to the lightweight construction method, this significantly increases rigidity and thus also mechanical stability. Consequently, the primary conductive lattice electrode may be of very thin construction, so that the introduction of foreign materials into the surrounding environment may be kept minimal. Moreover, the dimensionally stable but flexible lattice electrode may be adapted to fit curved surfaces of the structure to be protected. It is easily possible to adapt flexible but dimensionally stable wire netting to fit curved shapes, for example breakwaters. The same applies for the counter electrode. Moreover, it may be advantageous to provide the lattice electrode with a cylindrical design and/or the counter electrode with an annular design, wherein the counter electrode is arranged concentrically with the lattice electrode. In this way, both electrodes may be adapted to fit the round shape of a wind turbine foundation pile, for example. In this context, the lattice electrode may also be arranged concentrically with the counter electrode: the lattice electrode is arranged to that it encircles the foundation pile, the counter electrode is then attached over it in the form of a flat-belt ring having a somewhat larger diameter. In the case of a pile that is standing in deep water, multiple counter electrodes may be provided, spaced correspondingly up the length of the foundation pile.

Particularly when the antifouling system according to the invention is arranged on the foundation pile of a wind turbine in an inaccessible offshore location, it is particularly advantageous to provide an autarchic power supply for the electrodes. Therefore, a direct current source supplied by photovoltaic equipment may advantageously be used. The photovoltaic elements may be arranged above the water level on the wind turbine without difficulty. Systems for supplying electricity to other units are often already in place there. However, it is often easy to obtain an electricity supply from another regenerative source, for example via the transformer of the wind turbine, which may deliver the necessary controllable direct current without any problem.

The components to be used in the antifouling system according to the invention are relatively inexpensive compared with other antifouling solutions, and combined with the low current consumption (low-voltage current) they represent a relatively inexpensive alternative. No chemicals or other harmful substances are used, in particular no toxins. The antifouling system according to the invention is practically unaffected by wear and does not need to be renewed regularly—as is the case with known antifouling coatings. When necessary, the antifouling system may be removed easily without any human intervention on site.

Mechanical damage is easily repaired. Short circuits, for example, may be repaired without difficulty by maintenance personnel. In the case of conventional antifouling coatings on an insulating layer on a metallic ship's hull, damage of this kind can only be corrected by completely renewing the coating. Optionally, if damage is caused to the lattice electrode for example by the effects of force, or also when the lattice electrode is depleted as an anode, certain damage of this kind may be repaired in a third mode, known as temporary repair mode. The repair is effected by the deliberate deposition of aragonite, which however is not electrically conductive, and so increases the electrical resistance in the electrical circuit. Accordingly, such a repair should be considered a temporary measure that protects the antifouling system from more serious damage until maintenance personnel arrive. After this repair measure, the aragonite may easily be removed again by briefly switching to the second mode. A current must still be able to flow through the lattice electrode for temporary stabilisation with aragonite, so damage can only be repaired while it is still in the early stages. Damage of such kind may be detected for example by simple current measurements in the electrical circuit. A rising operating current is an indication of increasing resistance, and thus also an early sign of damage. In repair mode, the lattice electrode is switched as a cathode with the direct current source adjusted such that the current density generated thereby causes an accretion of hard aragonite (mohs hardness 3.5 . . . 4.5) on the lattice electrode. Mechanical weak points are thus temporarily stabilised again by the deposit of hard lime. The increased resistance due to the non-conductive lime is cancelled out again by the dissolution of the aragonite in the second operating mode after the full repair has been made.

Finally, it should be noted that the effect of the antifouling system according to the invention described here is extremely localised, and therefore does not represent a hazard for bodies in the vicinity that may be sensitive to its effects, such as may be present on boats in harbour areas, nor for people in the water. Moreover, no toxic components whatsoever are used with the invention. Further details about the antifouling system according to the invention are described in the following special description section.

FIG. 1 shows a general view of the electrochemical antifouling system 01 according to the invention for combating the adhesion of fouling organisms to a structure 02 that is wetted with seawater. In the embodiment selected, the structure is a foundation pile 03 of a wind turbine, for example, which has been erected offshore, in seawater 04. The antifouling system 01 has a lattice electrode 05 and two counter electrodes 06 as well as an adjustable direct current source 07 in a direct current circuit 23. Lattice electrode 05 is dimensionally stable and made from a single metallic component. No use is made of material combinations, for example from individual strands, conductive foil cores, electrically insulating filler materials and electrically conductive sheathing materials. In the embodiment, lattice electrode 05 consists of a simple, uninsulated steel or wire mesh 08 made from an iron-containing steel wire. Counter electrodes 06 consist of a corrosion-resistant material, for example titanium or a titanium alloy.

Figure 2:
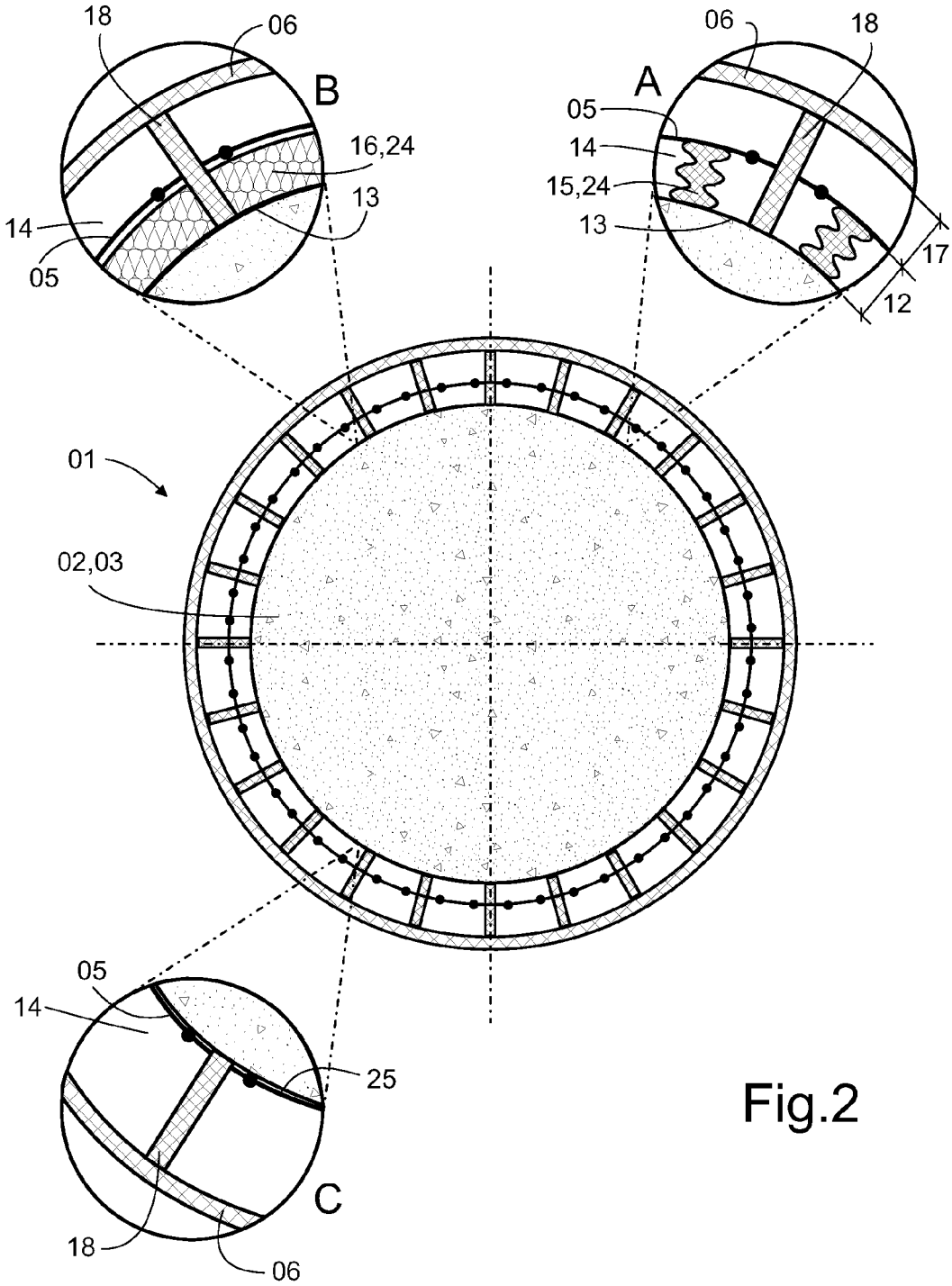
FIG. 2 is a cross-section through the arrangement of FIG. 1.

Lattice electrode 05 is flexible, and in the embodiment shown it has been adapted to the shape of the structure 02 to be protected. Lattice electrode 05 completely surrounds foundation pile 03 (diameter for example approximately 1.5 m) from the waterline 09 downwards, for example for a height in the range of 3 m. To some degree, this range is also aerated by wave motion, and is therefore particularly susceptible to fouling. Counter electrodes 06 have also been adapted to the shape of foundation pile 03, and are configured as annular flat ribbon electrodes 10 surrounding foundation pile 03 concentrically. Counter electrode 06 may be made for example from a material containing titanium, and thus be resistant to corrosion induced by electrolysis. Other construction details of antifouling system 01 according to the invention are shown in FIG. 2.

FIG. 1 also shows a device 11 for switching antifouling system 01 alternatively into different operating modes. This device 11 is connected to current source 07 and changes the current strength and/or polarity thereof. In this case, the arrangement of device 11 is only represented diagrammatically. However, it may also be located higher up on structure 02. Operation may be assured telemetrically via a distant transmitter. Current source 07 may be powered for example by a photovoltaic module on structure 02 that uses renewable solar energy.

The following modes of operation are selectable with antifouling system 01 according to the invention and may be achieved by adjusting the current:

I Continuous Operation Mode

In this mode, lattice electrode 05 functions as the cathode (−) and counter electrodes 06 function as the anode (+). A current J (unit symbol A) is set that is so high, it causes a sharp rise of the pH value in the region surrounding lattice electrode 05 that is functioning as the cathode (−), with the result that the pH value exceeds the pH tolerance limit of potential fouling organisms, which are then repelled. In addition, current density j is selected so high relative to the surface of the lattice electrode 05 functioning as the cathode (−) that soft, shearable brucite is precipitated at lattice electrode 05, on which the organisms either cannot gain a purchase or they slide off with it (parameter values are recorded for exemplary purposes in FIG. 1). Thus, a particularly effective dual fouling protection mechanism is achieved in operation mode.

II Temporary Depletion Mode

In this mode, lattice electrode 05 functions as the anode (+) and counter electrodes 06 function as the cathode (−). The polarity of current source 07 is inverted, the current flow is reversed. In this mode, decomposition by oxidation takes place at the lattice electrode 05 which is functioning as the anode (+). In this mode, the individual metallic component from which lattice electrode 05 is made, dissolves completely so that lattice electrode 05 is entirely eliminated. Thus it is able to be depleted without on-site intervention by personnel. The speed of decomposition depends on the selected strength of current J, and is accelerated as the current strength is increased. An increase in current J in turn raises the pH value, which is useful for purposes of fouling protection, but is no longer significant for depleting lattice electrode 05. This mode too is only selectable temporarily.

The processes described above take place at counter electrodes 06 in depletion mode. Because of the material they are made from, counter electrodes 06 do not disintegrate in any mode, so that they remain in place on structure 02 after depletion of the lattice electrode 05. However, since they are usually not of any great size, their continued presence does not cause any problems. If a new lattice electrode 05 is installed, counter electrodes 06 may easily be reused, so the fact that they are still there is even advantageous. The same applied for the residual insulating elements for lattice electrode 05.

The antifouling system 01 according to the invention may also have one further, optional mode of operation:

III Temporary Repair Mode

In this mode, damage to lattice electrode 05 that has not yet caused a break in the electrical circuit may be corrected by construction. The advantage of this mode is it may be used to stabilise lattice electrode 05 until the service personnel arrive, and correct the damage, for example by installing replacement lattices. In repair mode III, the strength of current J and current density j is reduced to such a level that hard aragonite is precipitated at lattice electrode 05, which is functioning as the cathode (−), as before, and stabilises it again. In the process, the pH value falls so that no effective fouling protection is provided any more. This mode must only be selected for short periods, and is used for repairing the lattice electrode 05, which is functioning as the cathode (−), without intervention by personnel at the site. Afterwards, the aragonite deposited may be removed again by briefly running operation mode II.

FIG. 2 is a detailed illustration of antifouling system 01 in a cross section through structure 02, the foundation pile 03. In this case, lattice electrode 05 is arranged in distance range 12 in front of surface 13 of foundation pile 03 such that surface 13 is within the area of influence 14 of the pH value rise in the seawater 04 that is caused by electrolysis, with the result that fouling organisms with a lower pH value tolerance are prevented from colonising the structure due to the sharp increase in the pH value caused by electrolysis. Lattice electrode 05 also serves as electrical insulation 24 with respect to surface 13 of foundation pile 03. In the embodiment show, foundation pile 03 consists of an electrically conductive material, such that lattice electrode 05 is arranged on insulators 15 (see section A in FIG. 2). Instead of the insulators 15, an insulation mat 16 (see section B in FIG. 2) may also be used, and lattice electrode 05 is laid directly over this. In the case of an electrically insulating surface 25, lattice electrode 05 may be placed directly on surface 13 of structure 02 (see section C in FIG. 2). Distance range 12 then approaches zero, with the result that the pH value increase in the area of influence 14 must necessarily include surface 13 of foundation pile 03, protecting it against fouling. Counter electrodes 06 are constructed in the form of rings, and are arranged on additional insulators 18 at a field-forming distance 17 from lattice electrode 05.

Figure 3:
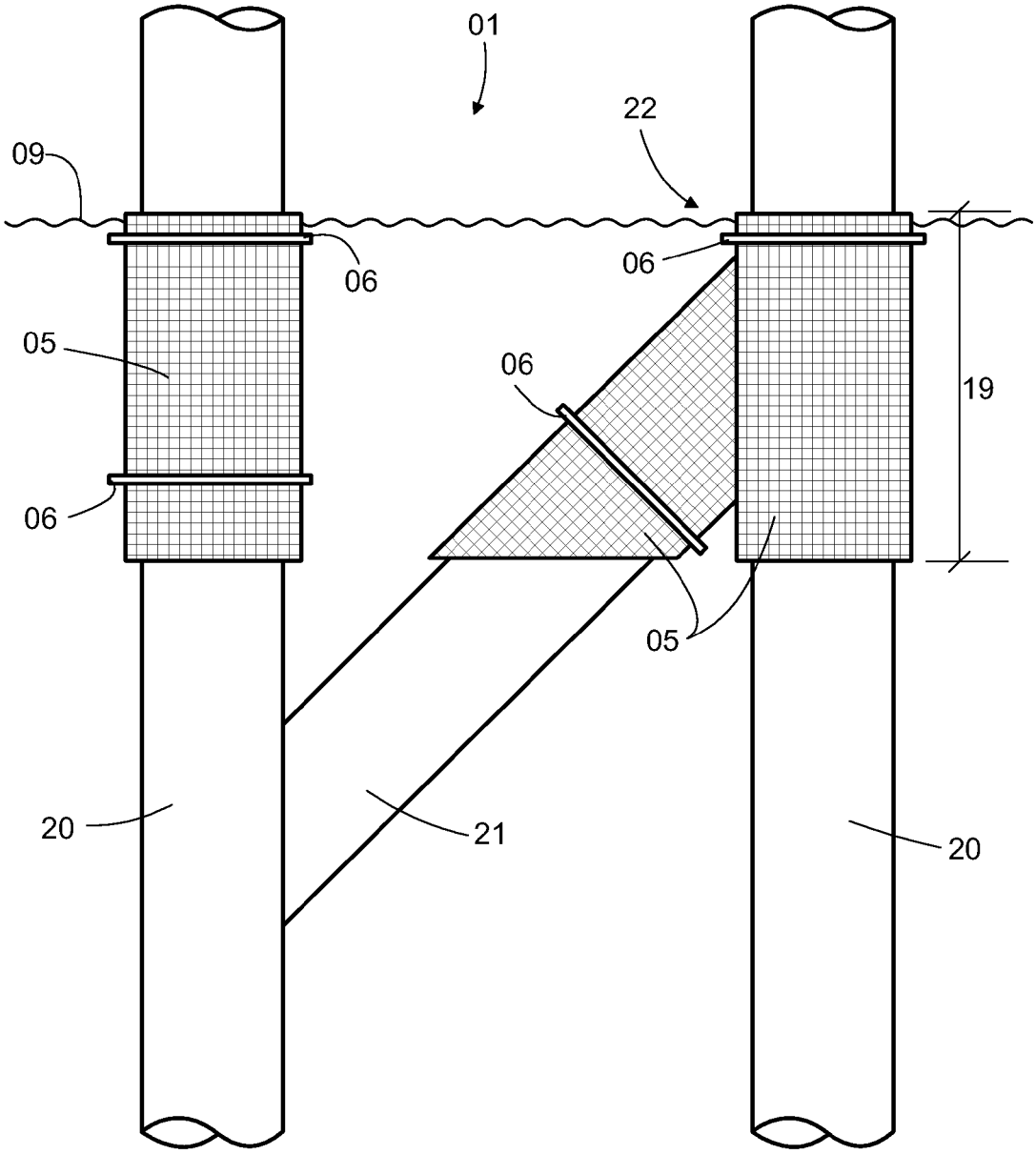
FIG. 3 is a general view of a modular configuration of the electrochemical antifouling system on multiple pilings.

FIG. 3 shows the arrangement of antifouling system 01 according to the invention in an area exposed to particularly heavy fouling 19 on multiple piers 20 and buttresses 21, for example a drilling platform. This shows a modular construction of antifouling system 01, with multiple lattice electrodes 05 and counter electrodes 06, as well as they way they are adapted to the respective shapes of piers 20 and buttresses 21. On the right in FIG. 3, a direct connection 22 between two lattice electrodes 05 is shown. The left portion of FIG. 3 shows an individual arrangement. All electrodes shown may be integrated in a single, combined electrical circuit, or they may be energised in separate circuits.

Finally, the table below lists exemplary but non-limiting values for the current density that is to be set in the antifouling system according to the invention.

| Mode of operation | Current density j ($A/m^2$) per effective lattice surface area (depends on lattice thicknesses used) |
|---|---|
| I - Operating mode | 35-42<br>Note: At these current densities, brucite is precipitated. Pure pH elevation takes place with current densities in a range as low as 22 to 28 $A/m^2$. |
| II - Depletion mode | 40-45 |
| III - Repair mode | 30 |

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

LEGEND

01 electrochemical antifouling system
02 structure wetted by seawater
03 foundation pile
04 seawater
05 lattice electrode
06 counter electrode
07 adjustable direct current source
08 uninsulated wire netting
09 waterline
10 ring electrode

11 device for alternative switching of 01
12 distance range between 05-13
13 surface of 02, 03
14 area of influence of electrolysis causing pH rise
15 insulator
16 insulating mat
17 distance between 06-05
18 additional insulator
19 area of fouling
20 pier
21 buttress
22 connection between 05-05
23 direct current circuit
24 electrical insulation
25 electrically insulationg surface

What is claimed is:

1. An electrochemical antifouling system for preventing fouling organisms from adhering to seawater-wetted structures, the system comprising:

a direct current circuit for creating an electrolytic environment in seawater, the direct current circuit having an adjustable direct current source;

a lattice electrode having a single metallic component so as to provide a dimensionally stable lattice structure, the lattice electrode being electrically insulated from a surface of a seawater-wetted structure:

at least one corrosion-resistant counter electrode having a polarity opposite to the lattice electrode and disposed at a distance from the lattice electrode; and a switching device configured to alternatively switch the lattice electrode to:

(a) a continuous operating mode with the lattice electrode functioning as a cathode, wherein the direct current source is adjusted so as to generate a current density so as to provide an accretion of soft brucite at the lattice electrode and a value higher than a pH value tolerance limit of fouling organisms that are to be combated in the seawater; and (b) a temporary depletion mode with the lattice electrode functioning as an anode, wherein the direct current source is adjusted so as to generate a direct current density so as to provide a reduction in oxidation at the lattice electrode and complete dissolution of the lattice electrode;

wherein the lattice electrode is disposed in a distance range from the surface of the seawater-wetted structure so that the surface lies within an area of influence of an increase in the pH value of the seawater caused by electrolysis.

2. The electrochemical antifouling system as recited in claim 1, further comprising an insulator for electrically insulating the lattice electrode from an electrically conductive surface of the seawater-wetted structure.

3. The electrochemical antifouling system as recited in claim 2, wherein the insulator includes an insulating mat.

4. The electrochemical antifouling system as recited in claim 1 wherein the lattice electrode is constructed from an uninsulated steel or wire mesh as the single metallic component.

5. The electrochemical antifouling system as recited in claim 4 wherein a shape of the lattice electrode is adapted to match curved surfaces of the seawater-wetted structure.

6. The electrochemical antifouling system as recited in claim 5, wherein the lattice electrode is cylindrical and the at least one counter electrode is annular, the at least one counter electrode disposed concentrically with the lattice electrode.

7. The electrochemical antifouling system as recited in claim 5, wherein the at least one counter electrode is annular, the at least one counter electrode disposed concentrically with the lattice electrode.

8. The electrochemical antifouling system as recited in claim 4 wherein a shape of the at least one counter electrode is adapted to match curved surfaces of the seawater-wetted structure.

9. The electrochemical antifouling system as recited in claim 1 wherein the lattice electrode is flexible.

10. The electrochemical antifouling system as recited in claim 9, wherein the lattice electrode is constructed from an uninsulated steel or wire mesh.

11. The electrochemical antifouling system as recited in claim 10, wherein the lattice electrode includes pleating.

12. The electrochemical antifouling system as recited in claim 1 wherein the at least one counter electrode is flexible.

13. The electrochemical antifouling system as recited in claim 1, further comprising multiple lattice electrodes connected to multiple counter electrodes so as to provide modular expansion capability.

14. The electrochemical antifouling system as recited in claim 1, wherein the direct current source is powered by a renewable energy source.

15. The electrochemical antifouling system of claim 14 wherein the renewable energy source is a photovoltaic source.

16. The electrochemical antifouling system as recited in claim 1, wherein the switching device is configured to switch the lattice electrode to a temporary repair mode so as to protect damaged areas of the lattice electrode where the lattice electrode functions as the cathode and the direct current source is adjusted so as to generate a current density so as to provide an accretion of hard aragonite.

17. The electrochemical antifouling system as recited in claim 1 wherein the at least one counter electrode is in a form of one of a lattice and a flat ribbon.

* * * * *